US012157998B2

(12) United States Patent
Graves et al.

(10) Patent No.: US 12,157,998 B2
(45) Date of Patent: Dec. 3, 2024

(54) SPACE DIVIDER SYSTEM FOR INDOOR FACILITIES

(71) Applicant: GRAND SLAM SAFETY, LLC, Croghan, NY (US)

(72) Inventors: Brian Graves, Croghan, NY (US); Elliot Martin, Castorland, NY (US); Mickey Lehman, Castorland, NY (US); Robert Lyndaker, Beaver Falls, NY (US)

(73) Assignee: GRAND SLAM SAFETY, LLC, Croghan, NY (US)

( * ) Notice: Subject to any disclaimer, the term of this patent is extended or adjusted under 35 U.S.C. 154(b) by 33 days.

(21) Appl. No.: 18/131,617

(22) Filed: Apr. 6, 2023

(65) Prior Publication Data

US 2023/0349152 A1 Nov. 2, 2023

Related U.S. Application Data

(60) Provisional application No. 63/335,870, filed on Apr. 28, 2022.

(51) Int. Cl.

| | |
|---|---|
| ***E04B 2/82*** | (2006.01) |
| ***E04B 2/74*** | (2006.01) |
| *A63B 71/02* | (2006.01) |

(52) U.S. Cl.

CPC ..... *E04B 2/7401* (2013.01); *E04B 2/821* (2013.01); *A47H 2201/00* (2013.01); *A63B 71/02* (2013.01)

(58) Field of Classification Search

CPC ..... E04B 2/74; E04B 2/7401; E04B 2/7453; E04B 2/821; E04B 2/766; E04B 2002/7479; A63B 71/02; A63B 71/04; A47H 5/02

See application file for complete search history.

(56) References Cited

U.S. PATENT DOCUMENTS

| | | | | | |
|---|---|---|---|---|---|
| 1,045,734 | A | * | 11/1912 | Newton | A44C 7/006 160/349.1 |
| 1,115,237 | A | * | 10/1914 | Nugent | E04G 21/30 160/368.1 |
| 1,371,149 | A | * | 3/1921 | Dudek | E06B 9/90 160/313 |
| 2,014,752 | A | * | 9/1935 | Vesey | A47H 5/02 160/349.2 |
| 2,027,992 | A | * | 1/1936 | Maurer | E06B 3/94 160/159 |
| 2,151,033 | A | * | 3/1939 | Jones | E06B 3/481 16/96 L |

(Continued)

*Primary Examiner* — Johnnie A. Shablack

(74) *Attorney, Agent, or Firm* — KDW Firm PLLC

(57) ABSTRACT

A system for eliminating gaps between a flexible sheet and an adjacent surface. A flexible sheet has a body, an upper edge, a lower edge, and a side edge. The flexible sheet is movable between retracted and deployed configurations. A knuckle member has first and second pivotable portions, the first portion is coupled to the lower edge of the flexible sheet and the second portion has a T-shaped first end coupled to a flap on the side edge of the flexible sheet. When the flexible sheet is retracted the second portion of the knuckle is angled with respect to the first portion. When the flexible sheet is deployed the second portion of the knuckle is coaxial with the first portion and the T-shaped first end moves the flap outward to engage the adjacent surface.

14 Claims, 14 Drawing Sheets

(56) References Cited

U.S. PATENT DOCUMENTS 2,181,101 A * 11/1939 Spenard ..... E06B 9/325 160/328
2,273,426 A * 2/1942 Washburn ..... A47H 5/00 160/344
2,610,681 A * 9/1952 Schaap ..... E06B 9/08 160/230
3,068,936 A * 12/1962 Haws ..... E06B 7/20 160/206
3,842,890 A * 10/1974 Kramer ..... E06B 9/40 160/26
4,091,857 A * 5/1978 Jacobs ..... A47H 1/18 211/119.12
4,161,850 A * 7/1979 Peterson ..... E04B 2/82 52/239
4,336,757 A * 6/1982 Toder ..... E05D 15/0608 104/96
4,373,570 A * 2/1983 Nussdorf ..... E04H 1/1272 160/DIG. 18
4,419,982 A 12/1983 Eckels
4,436,137 A 3/1984 Charles
4,541,469 A * 9/1985 Dressell ..... B60J 1/2088 160/178.1 R
4,597,549 A * 7/1986 Ryan ..... B64C 1/10 244/129.5
5,244,030 A * 9/1993 Cole ..... E05F 15/605 340/556
5,429,171 A 7/1995 Hamilton
6,354,043 B1 * 3/2002 Simon ..... E04B 2/7433 52/64
6,401,794 B1 * 6/2002 Hamilton ..... A47H 21/00 160/122
6,412,540 B2 * 7/2002 Hendee ..... E06B 9/0692 160/327
6,497,268 B1 * 12/2002 Peppett ..... E04B 2/7427 160/374.1
6,582,149 B1 * 6/2003 Holscher ..... F16B 7/187 403/240
6,630,755 B2 * 10/2003 Petriello ..... E05F 15/42 307/119
6,766,849 B1 * 7/2004 Tseng ..... E06B 9/266 160/332
6,942,001 B1 11/2005 Crider
8,905,249 B2 * 12/2014 Whitacre ..... E04B 2/7416 248/218.4
9,194,178 B2 11/2015 Andre de la Porte
9,447,602 B1 * 9/2016 Arias ..... E04H 15/003
10,011,985 B2 * 7/2018 Strong ..... F41H 5/013
10,724,298 B2 * 7/2020 Colson ..... E06B 9/42
2023/0250691 A1 * 8/2023 Riddle ..... E06B 9/521 160/349.1

* cited by examiner

SPACE DIVIDER SYSTEM FOR INDOOR FACILITIES

CROSS-REFERENCE TO RELATED APPLICATIONS

This is a non-provisional patent application of pending provisional patent application Ser. No. 63/335,870, filed Apr. 28, 2022, the entirety of which application is incorporated by reference herein.

BACKGROUND OF THE DISCLOSURE

Field of the Disclosure

Embodiments of the disclosure relate generally to space dividing arrangements for interior spaces, and more particularly to a space divider for use in dividing a sports facility into multiple individual sports activity spaces.

Background of the Disclosure

An issue in connection with sports training, competition, and the like is that full-sized interior sports spaces (e.g., gymnasiums, field houses) are often much larger than needed for individual training/activity groups. Thus, dividing such spaces into individual sub-spaces is desirable so that individual groups can simultaneously engage in sports training or other group activities separate from one another. While solutions exist for dividing larger spaces into smaller sub-spaces, such solutions suffer from a variety of disadvantages.

For example, floor mounted rigid or semi-rigid dividers can cause injury to users impacting the dividers during training. Flexible ceiling mounted dividers (e.g., curtains) can reduce such injury risks due to their inherent flexibility and are also conveniently retractable for compact storage in the overhead when not in use. Current ceiling mounted dividers suffer from the disadvantage, however, that gaps inherently exist between the dividers and adjacent wall or perimeter fencing. Such gaps can allow balls or other objects to pass from one space to another, increasing the risk of injury to individuals in other spaces.

It would be desirable to provide a system for dividing larger indoor sports spaces into smaller useable training/activity spaces that addresses the above noted disadvantages.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

The present disclosure relates to a device which makes it possible to rapidly and conveniently divide a large indoor sports space (e.g., gymnasium, field house) into multiple smaller enclosed spaces.

A system is disclosed for maintaining an edge of a flexible sheet member in a predetermined position with respect to an adjacent surface. The system can include a flexible sheet member having a body portion, an upper edge portion, a lower edge portion, and a side edge portion. The upper edge portion can be coupleable to a vertical support mechanism for vertically suspending the flexible sheet member. The flexible sheet member can be movable between a retracted configuration and a deployed configuration. A knuckle member may have first and second portions pivotably coupled to each other, the first portion coupled to the lower edge portion of the flexible sheet member, the second portion having a T-shaped first end coupled to the side edge portion of the flexible sheet member. When the flexible sheet member is in the retracted configuration the second portion of the knuckle member can be oriented at an oblique angle with respect to the first portion. When the flexible sheet member is in the deployed configuration the second portion of the knuckle member can be oriented coaxial with the first portion and T-shaped first end of the knuckle member can move the side edge portion outward away from the first portion and toward the adjacent surface.

The side edge portion may further comprise a flap oriented perpendicular to a plane formed by the body portion when the flexible sheet member is in the deployed configuration. The T-shaped first end can be coupled to the flap, and when the flexible sheet member is in the deployed configuration the second portion of the knuckle member can be oriented coaxial with the first portion and the T-shaped first end of the knuckle member can move the flap outward away from the first portion and toward the adjacent surface. A top end of the flap can be coupled to a vertical tensioning element such that when the flexible sheet member is in the deployed configuration a bottom end of the flap provides vertical support for the second portion of the knuckle member.

The lower edge portion can be coupled to a tensioning member for maintaining the flexible sheet member taut when the flexible sheet member is in the deployed configuration. The first portion of the T-shaped first end can be coupled to the tensioning member. The T-shaped first end can be rotatable about an axis of the second portion by a predetermined amount. The T-shaped member can have a central member and first and second end members, the central member oriented perpendicular to an axis formed by the second portion. The first and second end members may be oriented to form an oblique angle with respect to the central member.

The system may also include a shackle pad associated with the adjacent surface, the shackle pad received within the central member and the first and second members when the flexible sheet member is in the deployed configuration. The adjacent surface may comprise a perimeter fence, the perimeter fence including a reinforced vertical section directly adjacent to the side edge portion of the flexible sheet member when the flexible sheet member is in the deployed configuration.

A device is disclosed for maintaining an edge of a flexible sheet member in a predetermined position with respect to an adjacent surface. The device may include a knuckle member having first and second portions pivotably coupled to each other, the first portion coupleable to a lower edge portion of a flexible sheet member, the second portion having a T-shaped first end coupleable to a side edge portion of the flexible sheet member. In a first configuration the second portion of the knuckle member can be oriented at an oblique angle with respect to the first portion, and in a second configuration the second portion of the knuckle member can be oriented coaxial with the first portion and the T-shaped first end of the knuckle member is configured to move the side edge portion outward away from the first portion and toward the adjacent surface.

The T-shaped first end can be coupleable to a flap of the side edge portion of the flexible sheet member. In the second configuration the second portion of the knuckle member can be oriented coaxial with the first portion and the T-shaped first end of the knuckle member can be configured to move the flap outward away from the first portion and toward the adjacent surface. The T-shaped first end may be rotatable about an axis of the second portion by a predetermined amount. The T-shaped member can have a central member and first and second end members, the central member oriented perpendicular to an axis formed by the second portion, and the first and second end members can be oriented to form an oblique angle with respect to the central member. The first portion can be tubular and can include an opening for receiving a lifting cable.

A method for maintaining an edge of a flexible sheet member in a predetermined position with respect to an adjacent surface is disclosed. The method can include suspending a flexible sheet member having a body portion, an upper edge portion, a lower edge portion, and a side edge portion, moving the flexible sheet member from a retracted configuration to a deployed configuration, and pressing a side edge portion of the flexible sheet member against the adjacent surface as the flexible sheet member approaches the deployed configuration.

The step of pressing the side edge portion of the flexible sheet member against the adjacent surface can include pressing a flap positioned on the side edge portion against the adjacent surface as the flexible sheet member approaches the deployed configuration. The step of pressing the flap may include pivoting a T-shaped first end of a knuckle member with respect to the lower edge portion of the flexible sheet member, the T-shaped first end coupled to the flap. The step of pressing the flap comprises tensioning a top end of the flap such that when the flexible sheet member is in the deployed configuration a bottom end of the flap vertically supports a T-shaped first end of the knuckle member.

The T-shaped first end may be rotatable about an axis of the knuckle member by a predetermined amount. Further comprising maintaining the flexible sheet member taut when the flexible sheet member is in the deployed configuration. The method may further comprise engaging the T-shaped first end with a shackle pad associated with the adjacent surface, the shackle pad received within a portion of the T-shaped member when the flexible sheet member is in the deployed configuration. The adjacent surface may include a perimeter fence, and the step of pressing the flap can include pressing the flap against the perimeter fence. The perimeter fence includes a reinforced vertical section positioned directly adjacent to the side edge portion, and the step of pressing the side edge portion can include pressing the side edge portion against the reinforced vertical section.

BRIEF DESCRIPTION OF THE DRAWINGS

The accompanying drawings illustrate preferred embodiments of the disclosed method so far devised for the practical application of the principles thereof, and in which.

Figure 1A:
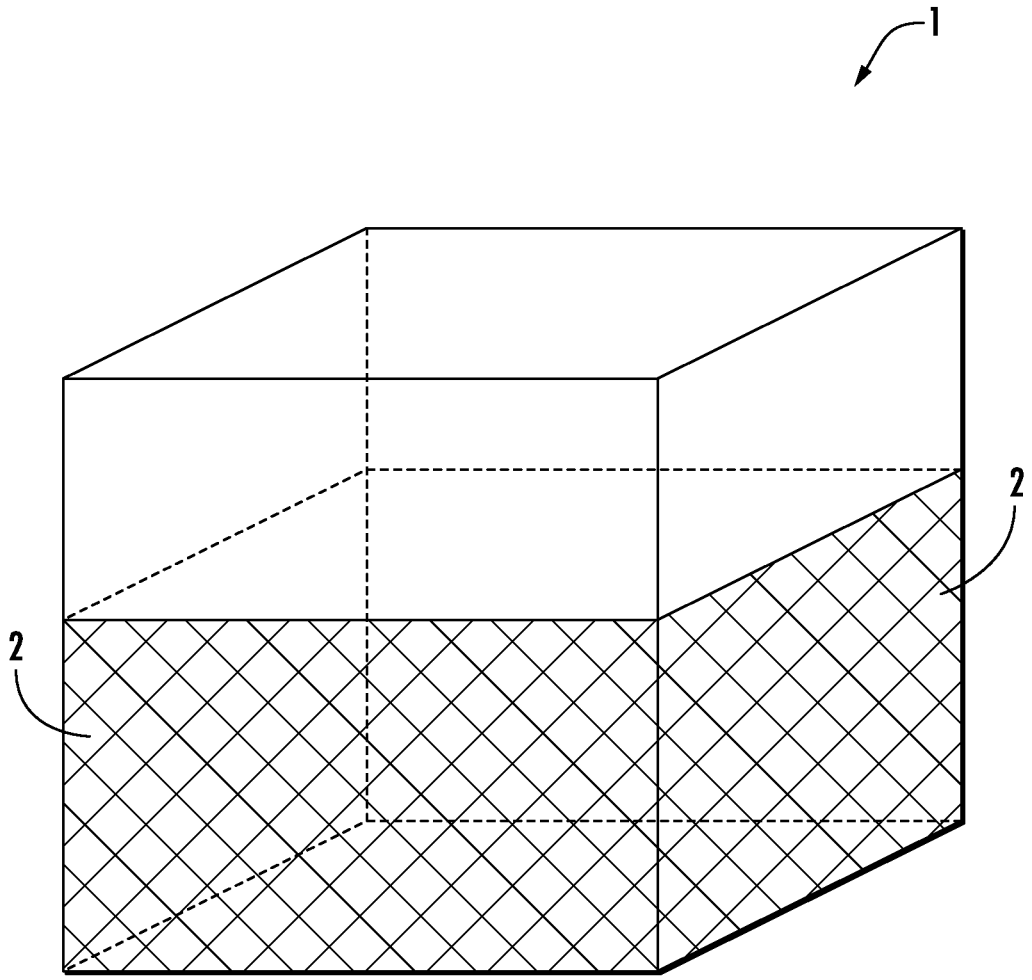
FIG. 1A is an isometric representation of an indoor sports facility, with a perimeter fence disposed about the inner perimeter of the facility.

It should be understood that the drawings are not necessarily to scale and that the disclosed embodiments are sometimes illustrated diagrammatically and in partial views. In certain instances, details which are not necessary for an understanding of the disclosed systems and devices, or which render other details difficult to perceive may have been omitted. It should be further understood that this disclosure is not limited to the specific embodiments illustrated herein.

DESCRIPTION OF EMBODIMENTS

Various features, aspects, or the like of a divider system will now be described more fully hereinafter with reference to the accompanying drawings, in which one or more aspects or features of the space divider system for indoor facilities will be shown and described. It should be appreciated that the various features, aspects, or the like may be used independently of, or in combination, with each other. It will be appreciated that a divider system as disclosed herein may be embodied in many different forms and should not be construed as being limited to the embodiments set forth herein. Rather, these embodiments are provided so that this disclosure will convey certain aspects or features of the space divider system for indoor facilities to those skilled in the art. In the drawings, like numbers refer to like elements.

Referring now to FIG. 1, an example indoor sports facility 1 includes a perimeter fence 2 disposed about the entire interior of the facility. It will be appreciated that the illustrated arrangement is merely exemplary, and that facilities in which the disclosed system can be implemented will have a variety of sizes, shapes and configurations, and that in many instances a perimeter fence 2 will not enclose the entire indoor facility but will instead enclose merely a portion of the facility. In some embodiments the perimeter fence is a SPECTO® fence manufactured by Grand Slam Safety LLC, 9793 Bridge Street, Croghan, NY 13327. It will be also appreciated that the disclosed system can be used without a perimeter fence and can thus be used to enclose a portion of a facility by sealing against any of a variety of surfaces, including, but not limited to, a perimeter fence 2, Specto® fencing, dasher board(s), rigid wall(s), divider curtain(s), netting, wall padding, or any other appropriate interior building structure. The disclosure will proceed by referring to the aforementioned surfaces collectively as an "adjacent surface 2".

Figure 1B:
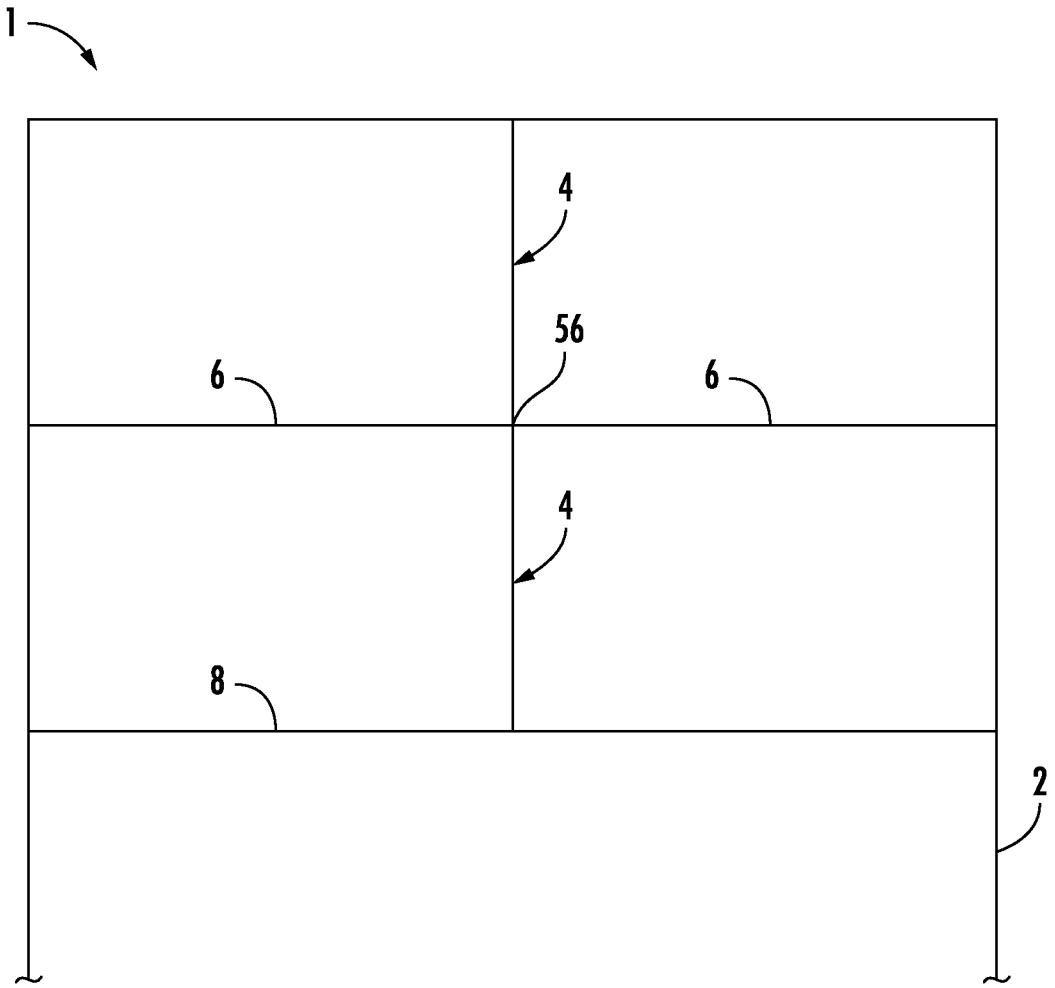
FIG. 1B is a plan view of the indoor sports facility shown in FIG. 1A, incorporating the disclosed dividing system.

FIG. 1B illustrates a non-limiting example layout of a plurality of flexible sheets 4, 6, 8 configured to subdivide the interior of the facility 1 into a plurality of sub-spaces. The flexible sheets 4, 6, 8 can have different lengths and may be combined as desired to form sub-spaces sized to accommodate the variety of activities that will take place therein. The flexible sheets 4, 6, 8 can be made from any material appropriate to serve as barriers and temporary walls, and in some embodiments, the flexible sheets made from heavy-duty fabric netting and vinyl such as SPECTO® divider curtains manufactured by Grand Slam Safety LLC. As will be appreciated, manufacturing the flexible sheets 4, 6, 8 from heavy-duty fabric netting and vinyl enables the flexible sheets to be retracted into the overhead in a compact form when not in use, and enables the flexible sheets to be deployed (i.e., lowered) into place quickly and easily to subdivide the overall space.

Figure 2:
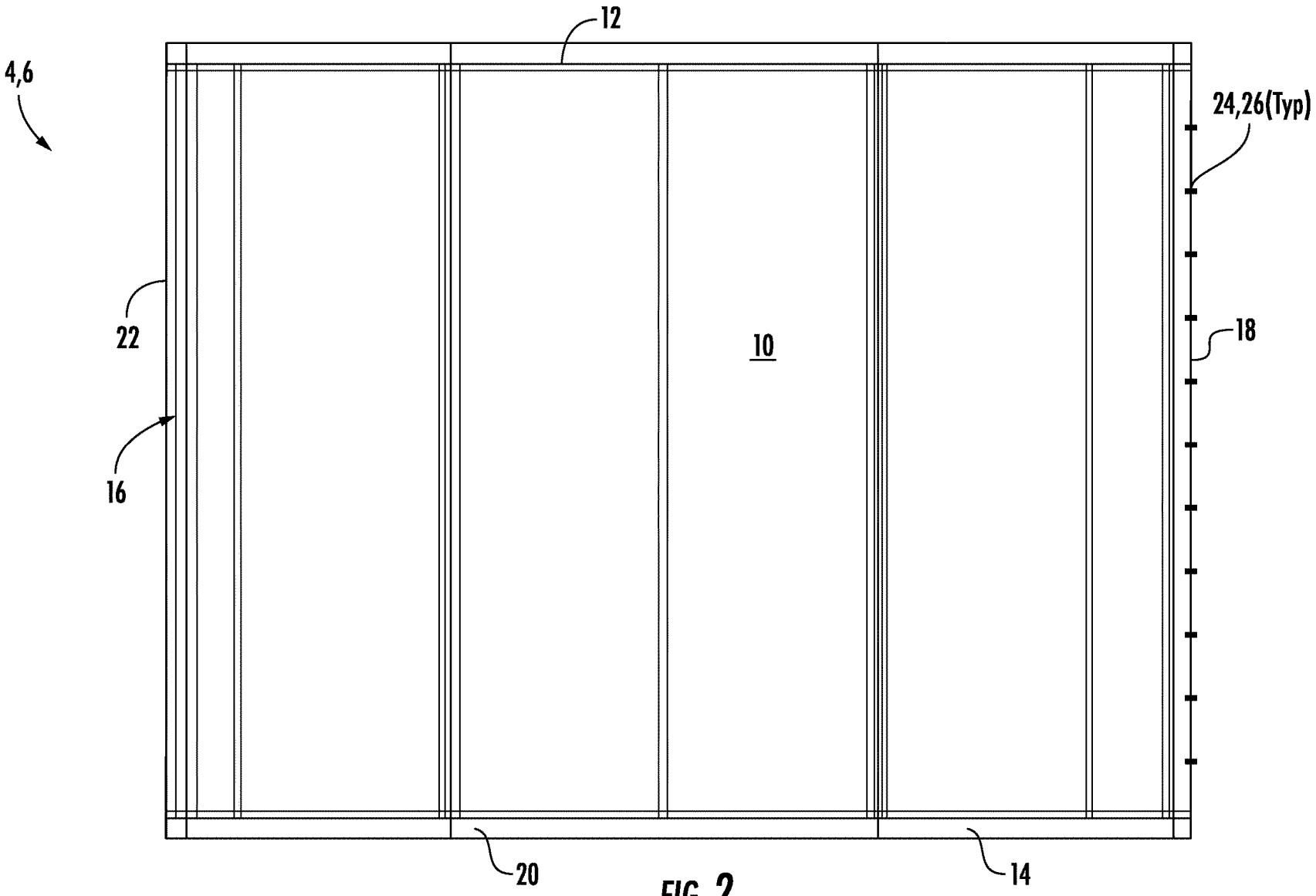
FIG. 2 is a side view of a flexible sheet member of the dividing system of FIG. 1B.

As shown in FIG. 2, flexible sheets 4, 6 includes a body portion 10, an upper edge portion 12, a lower edge portion 14, and first and second side edge portions 16, 18. The upper edge portion 12 may be coupled to a vertical support mechanism (not shown) for vertically suspending the flexible sheet 4 at a desired height above a floor of the facility. The lower edge portion 14 may be coupled to a tensioning member 20, which in one non-limiting example embodiment is a hollow metal tube or pipe received within a longitudinal pocket of the lower edge portion 14. The tensioning member can be of sufficient weight that it causes the flexible sheet 4 to move smoothly and completely from the retracted configuration to the deployed configuration.

The first side edge portion 16 may have a flap 22 (FIG. 4) oriented perpendicular to a plane formed by the body portion 10 of the flexible sheet 4, 6 when the flexible sheet is in the deployed configuration. As will be discussed in more detail later, when the flexible sheet 4, 6 is deployed this flap 22 can be pressed against a portion of the adjacent surface 2 to eliminate any gaps between the flexible sheet 4 and the adjacent surface. The second side edge portion 18 may have a plurality of openings 24 for receiving a plurality of fasteners 26, such as D-rings, for coupling the flexible sheet 4 to one or more adjacent flexible sheets 4, 6 as desired. In the illustrated embodiment, the body portion 10 of the flexible sheet 4, 6 can be formed from a plurality of panel members coupled together, although this is not critical and the body portion 10 of one or more of the flexible sheets 4, 6, 8 can be formed from a single panel member. Flexible sheets 4, 6 can be provided in any of a variety of different lengths depending on the size, shape, or other configuration of the space to be divided. For example, FIG. 2 illustrates an embodiment in which flexible sheet 4 is shorter than flexible sheet 6.

Figure 3:
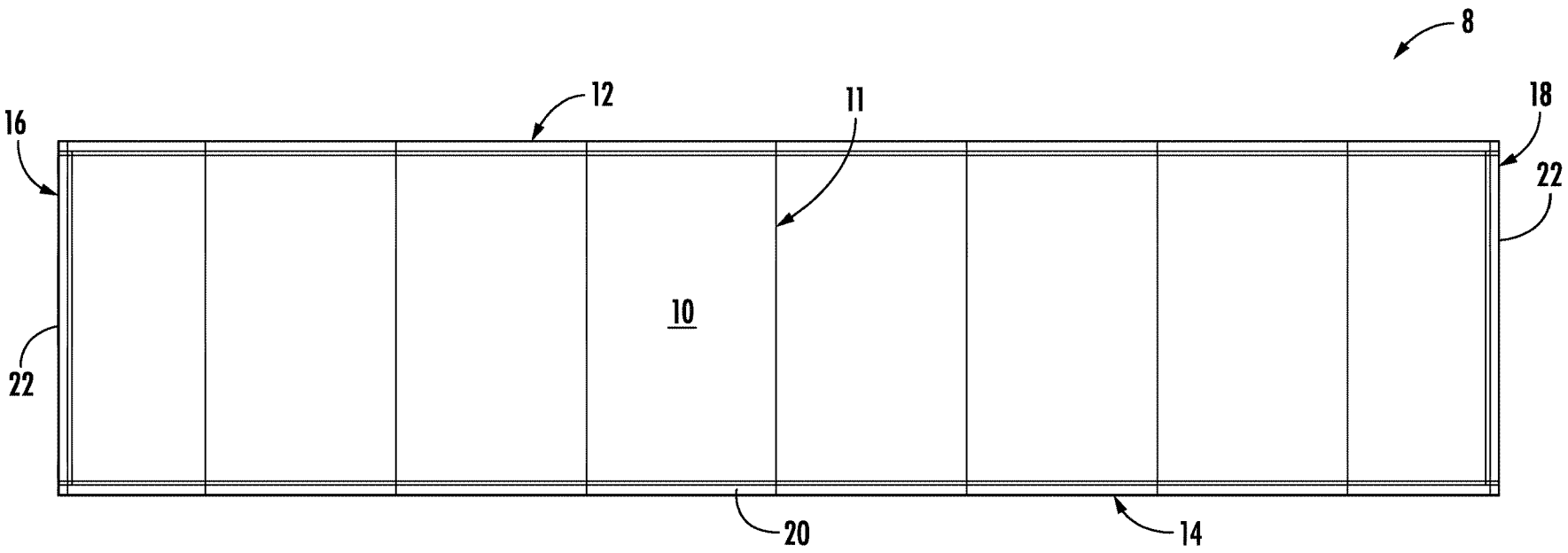
FIG. 3 is a side view of another flexible sheet member of the dividing system of FIG. 1B.

FIG. 3 illustrates flexible sheet 8 having some or all of the features of flexible sheet 4, including body portion 10, upper and lower edge portions 12, 14, and first and second side edge portions 16, 18. A tensioning member 20 can be coupled to the lower edge portion 14, a flap 22 can be provided on the first side edge portion 16, and the second side edge portion can include a plurality of openings 24 for receiving a plurality of fasteners 26.

Figure 4:
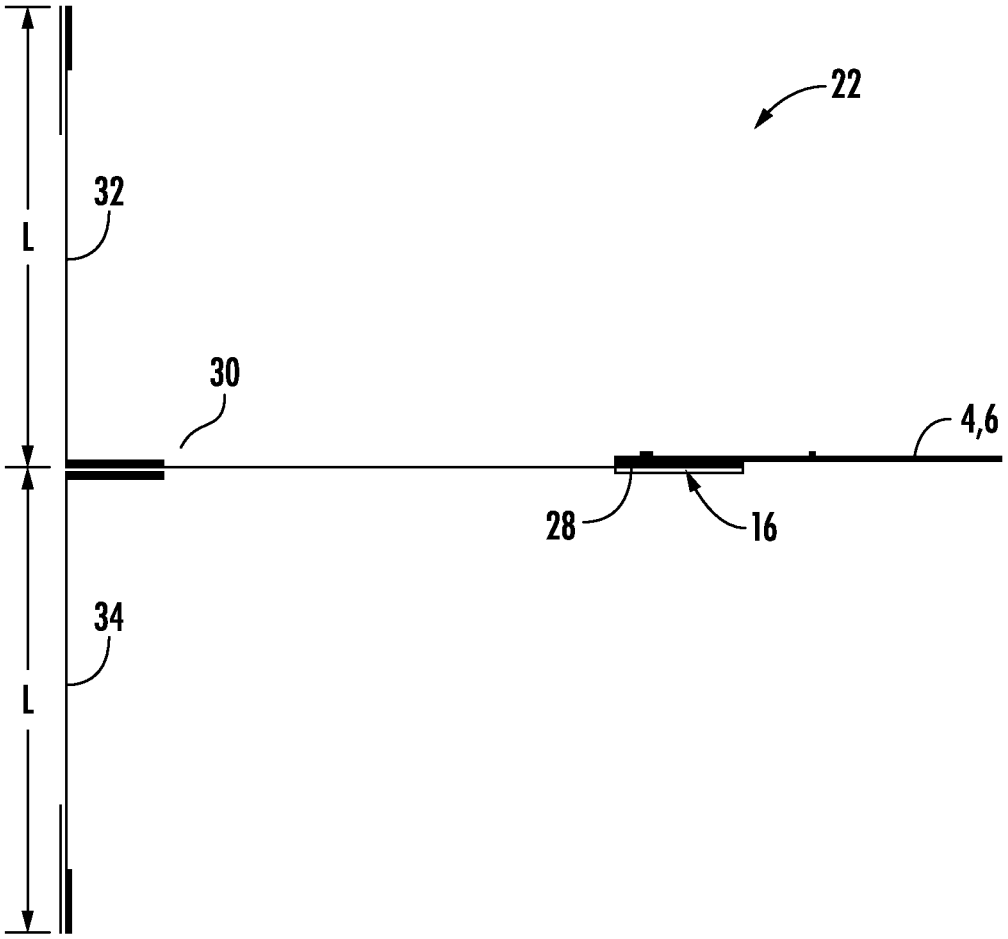
FIG. 4 is a top plan view of a side edge portion of the flexible sheet members of FIGS. 2 and 3.

Although not shown in detail, flexible sheet 8 can have some or all of the features of flexible sheets 4, 6. For example, one or both of the first and second side edge portions 16, 18 of flexible sheet 8 may have a flap 22 (FIG. 4). In some alternative embodiments one or both of the first and second side edge portions 16, 18 of flexible sheet 8 may be arranged to accept a plurality of fasteners, such as D-rings (not shown), for coupling the flexible sheet 8 to one or more adjacent flexible sheets 4, 6, as desired. In some embodiments, one or both of the first and second side edge portions of the flexible sheet 8 may be free of coupling features. In further embodiments, the body portion 10 of the flexible sheet 8 may have a vertically oriented region 11 comprising a reinforced flat or curved portion having a mating feature such as a shackle pad 27 (FIGS. 7B, 7C) for sealing against the flap 22 and knuckle member 36 (FIGS. 5, & 6) of the first or second side edge portion 16, 18 of one or more adjacent flexible sheets 4, 6.

FIG. 4 shows flap 22 which as previously noted may be provided on the first side edge portion 16 of the flexible sheets 4, 6, or 8. The flap 22 may have a first end 28 coupled to the first side edge portion 16, and a middle portion 30 coupled to first and second flap segments 32, 34. The first end 28 can be coupled to the first side edge portion 16 using any appropriate joining technique, including hook and loop fasteners, sewing, adhesive, and the like. In some embodiments, the flap 22 may be an integral part of the flexible sheet 4, 6, 8. The first and second flap segments 32, 34 are flexible and can be positioned to form a "T" shape with respect to the middle portion 30. Thus, the first and second flap segments 32, 34 each has a length "L" as measured from the middle portion 30. In non-limiting example embodiments, the length "L" can be in the range of from 0-inches to 12-inches. As illustrated, the first and second flap segments 32, 34 can be pressed against a portion of adjacent surface 2, another flexible sheet, or an interior structure of the facility to eliminate gaps between the flexible sheet 4, 6, 8 and the adjacent surface 2. As will be appreciated, this gap elimination feature can serve to prevent balls or other objects from passing from one sub-space of the facility (defined by flexible sheets 4, 6, 8) to another adjacent sub-space. It will be appreciated that some embodiments of flexible sheets 4, 6, 8 may not include a flap 22 with first and second flap segments 32, 34. In such embodiment, the first and/or second side edge portions 16, 18 of the associated flexible sheet 4, 6, 8 may be pressed against a portion of adjacent surface 2 to eliminate gaps between the flexible sheet 4, 6, 8 and the adjacent surface.

As mentioned, when the flexible sheets 4, 6, 8 are deployed to form the aforementioned sub-spaces, the first and second flap segments 32, 34 may be pressed against a portion of adjacent surface 2 to eliminate gaps between the edges of the flexible sheets 4, 6, 8 and the adjacent surface. In one embodiment, illustrated in FIGS. 5 and 6, a knuckle member 36 can be used to perform this pressing function. Knuckle member 36 has first and second portions 38, 40 coupled to each other at a pivot joint 42 so that the second portion 40 can pivot with respect to the first portion 38 about the axis of pin 44. The first portion 38 of the knuckle member is sized and shaped to couple to the tensioning member 20. As mentioned, the tensioning member 20 may in some embodiments be a hollow metal tube or pipe, and thus the first portion 38 of the knuckle member 36 may be of cylindrical shape sized to fit within or over the tensioning member and be fixed thereto by a press fit or other appropriate joining mechanism. The first portion 38 may also have at least one opening 46 for coupling to a cable or other structure so that the flexible sheet 4, 6, 8 can be raised/lowered by retracting/deploying the cable or structure. In some embodiments the opening 46 can be provided in an end portion of the tensioning member 20.

The second portion 40 of the knuckle member 36 can be coupled at one end to the first portion 38 and can be coupled at an opposite end to a T-shaped element 48. The T-shaped element 48 may be coupled to the flap 22 of the first side edge portion 12 of the associated flexible sheet 4, 6, 8. The T-shaped element 48 may be received within a pocket 23 (FIGS. 7A-7C) disposed in a lower portion 25 of the flap 22, and central member 50 and first and second end members 52, 54 of the knuckle member 36 can be of sufficient weight that they cause the flap 22 to move downward under the force of gravity to smoothly and completely transition from the retracted configuration to the deployed configuration along with the associated flexible sheet 4, 6, 8.

Figure 5:
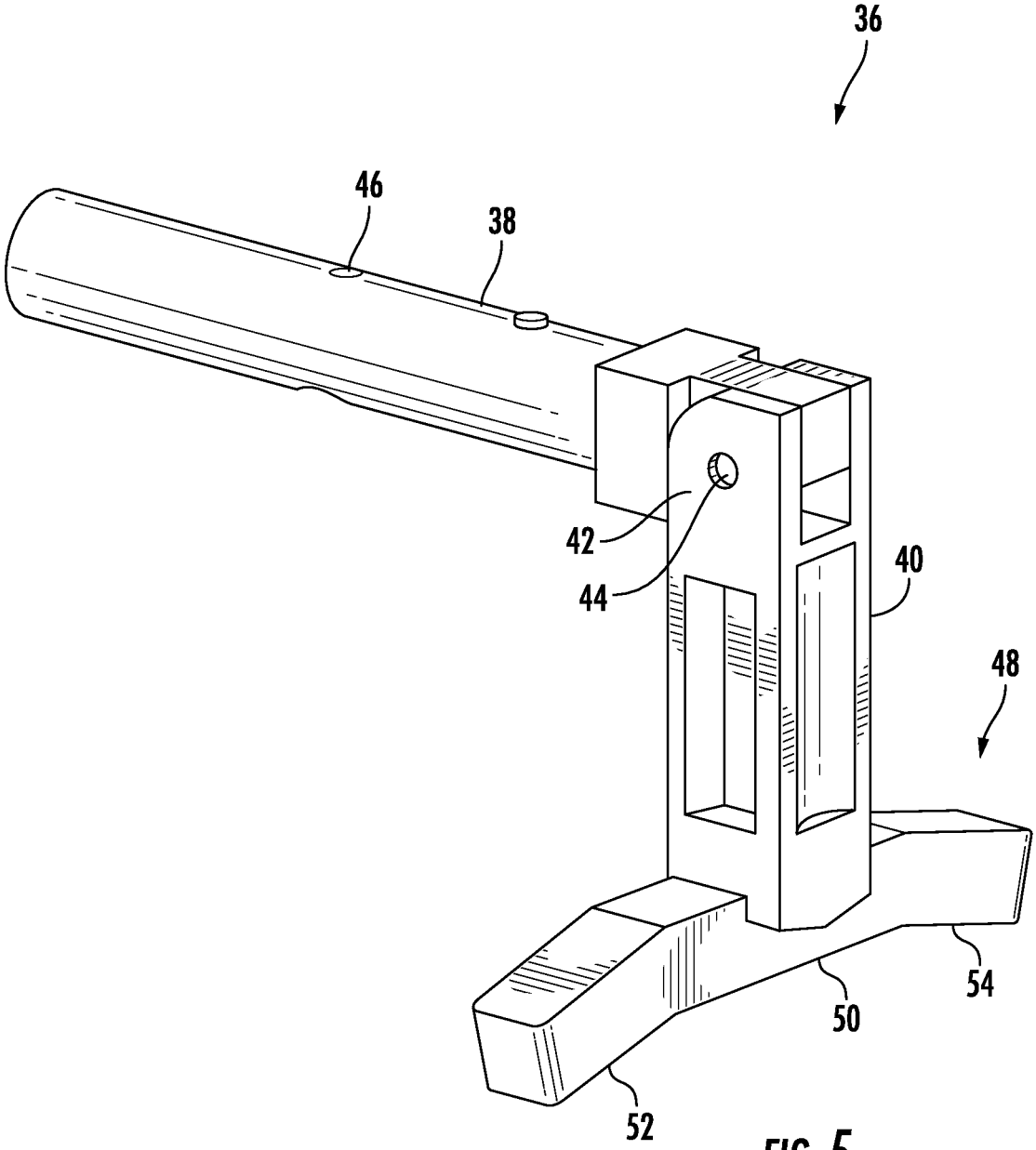
FIG. 5 is an isometric view of a knuckle member of the dividing system of FIG. 1B, the knuckle member being shown in a first position.
Figure 6:
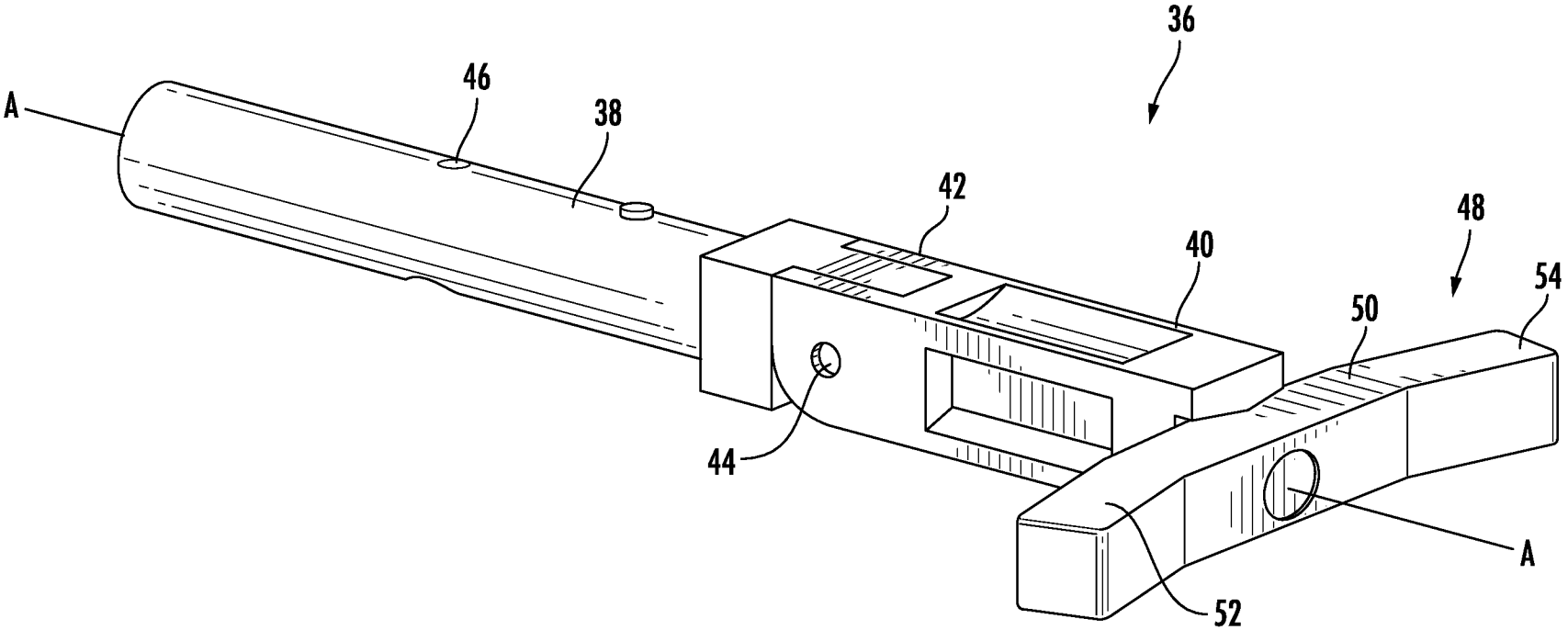
FIG. 6 is an isometric view of a knuckle member of the dividing system of FIG. 1B, the knuckle member being shown in a second position.

FIG. 5 illustrates the configuration of the knuckle member 36 when the flexible sheet 4, 6, 8 before the flexible sheet 4, 6, 8 is in the fully deployed configuration. As can be seen, in this configuration the second portion 40 is rotated downward, about pivot joint 42. This causes the flap 22, which is attached to the second portion 40, to be pulled inward toward the first portion 38 of the knuckle member 36 so that the first side edge portion 12 of the flexible sheet 4, 6, 8 is drawn away from the adjacent surface 2. This enables the flexible sheet 4, 6, 8 to be raised and lowered without the first side edge portion 12 interfering with (i.e., dragging along) the adjacent surface 2 as the flexible sheet 4, 6, 8 is raised/lowered.

When, however, the flexible sheet 4, 6, 8 is moved close to the fully deployed configuration, the flap 22, which is held in tension by a fastener, cable, or other structure coupled at its upper end, pulls the second portion 40 of the knuckle member 36 upwards so that it pivots about pivot joint 42. As the second portion 40 continues to pivot about the pivot joint 42 the T-shaped element 48 moves outward to press the flap 22 against the adjacent structure to seal the flap thereto (via first and second flap segments 32, 34). When the flexible sheet 4, 6, 8 is retracted, the second portion 40 of the knuckle member 36 again pivots about the pivot joint 42, releasing the flap 22 from engagement with the adjacent surface 2 to enable a smooth retraction of the panel member.

In some embodiments a spring or other tensioning element (not shown) may be positioned between the first and second portions 38, 40 of the knuckle member 36 to bias the first and second portions toward the configuration shown in FIG. 5. Such an arrangement can ensure that when the flexible sheet 4, 6, 8 is retracted from the fully deployed configuration, the second portion 40 of the knuckle member 36 will pivot with respect to the first portion 38 about the pivot joint 42, thus drawing the flap 22 away from the adjacent surface 2, and allowing the flexible sheet 4, 6, 8 to be retracted without dragging along the adjacent surface.

In the illustrated embodiment the T-shaped element 48 comprises a central member 50 and first and second end members 52, 54. The central member 50 may be oriented perpendicular to a longitudinal axis A-A of the knuckle member 36, while the first and second end members may be oriented to form an oblique angle with respect to the central member 50. In some embodiments the adjacent surface 2 may include a shackle pad 27 (FIGS. 7B, 7C). The shackle pad 27 may be fixed to a portion of the adjacent surface 2 directly adjacent to the floor 55 and may be received within the central member 50 and the first and second members 52, 54 when the flexible sheet 4, 6, 8 is in the fully deployed configuration (see FIG. 7B). The shackle pad 27 may serve to maintain the knuckle member 36 (and flexible sheet 4, 6, 8) in position with respect to the adjacent surface 2, preventing the lower edge portion 14 of the flexible sheet from moving parallel to the floor when the panel is deployed.

In some embodiments the T-shaped element 48 may be rotatable about the longitudinal axis A-A of the knuckle member 36 by a predetermined amount. In non-limiting example embodiments this predetermined amount may be +/−7 degrees This rotatability may serve to facilitate engagement between the T-shaped element 48 and the shackle during deployment. This rotatability may further server to ensure equal vertical tension of the first and second flap segments 32, 34. In some embodiments the adjacent surface 2 may include a reinforced vertical section (not shown) disposed directly adjacent to the flap 22 of the first or second side edge portion 16, 18 of the associated flexible sheet 4, 6, 8 when the flexible sheet member is in the deployed configuration. This reinforced vertical section may ensure that adjacent surface 2 remains taught in the region in which it engages the flap 22 to minimize or eliminate the chance that a gap may form between the two due to a bowing of the perimeter fence.

Figure 7A:
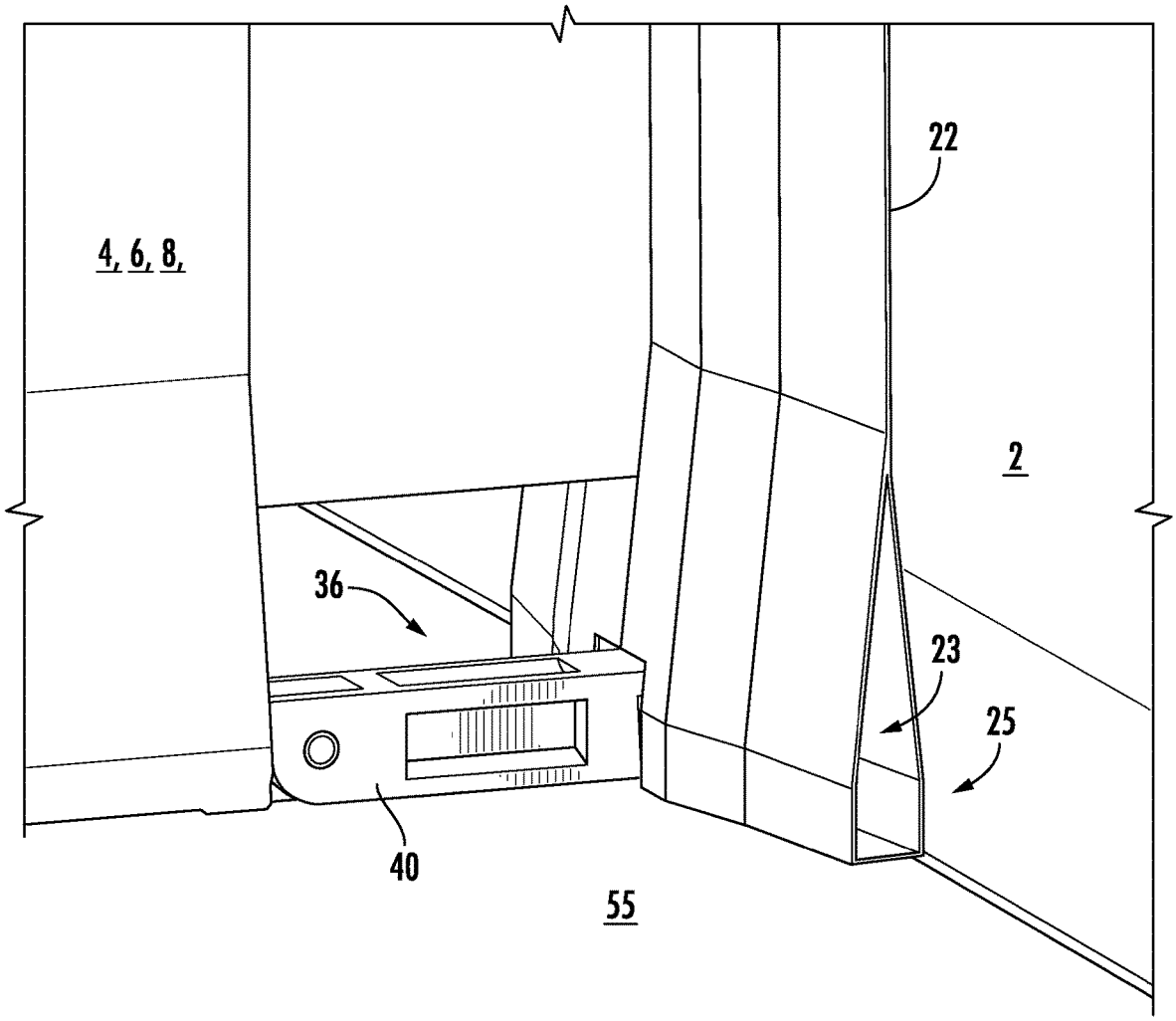
FIGS. 7A-C are isometric views of the knuckle member, associated flexible sheet, and shackle pad of the dividing system of FIG. 1B.
Figure 7B:
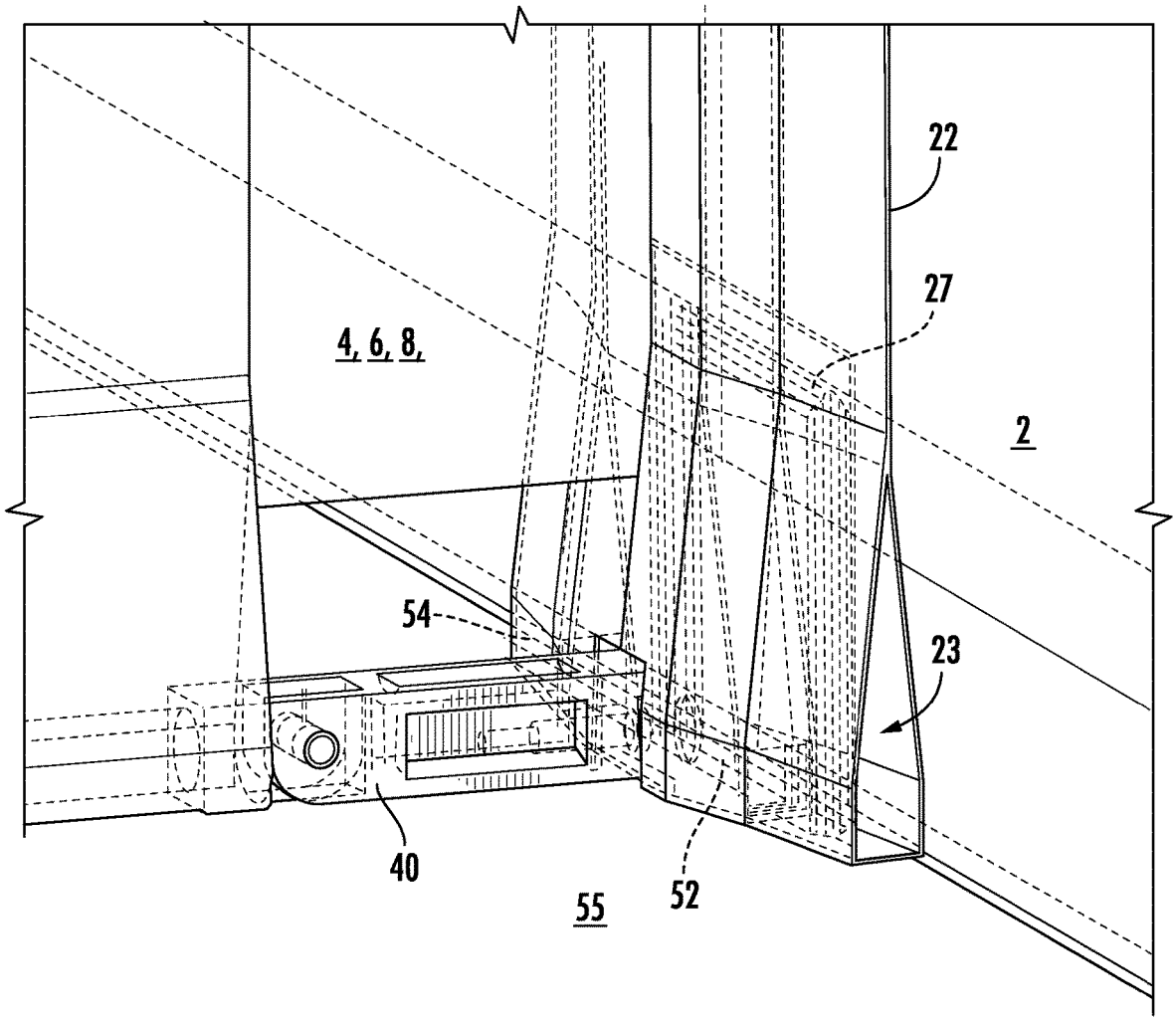
Figure 7C:
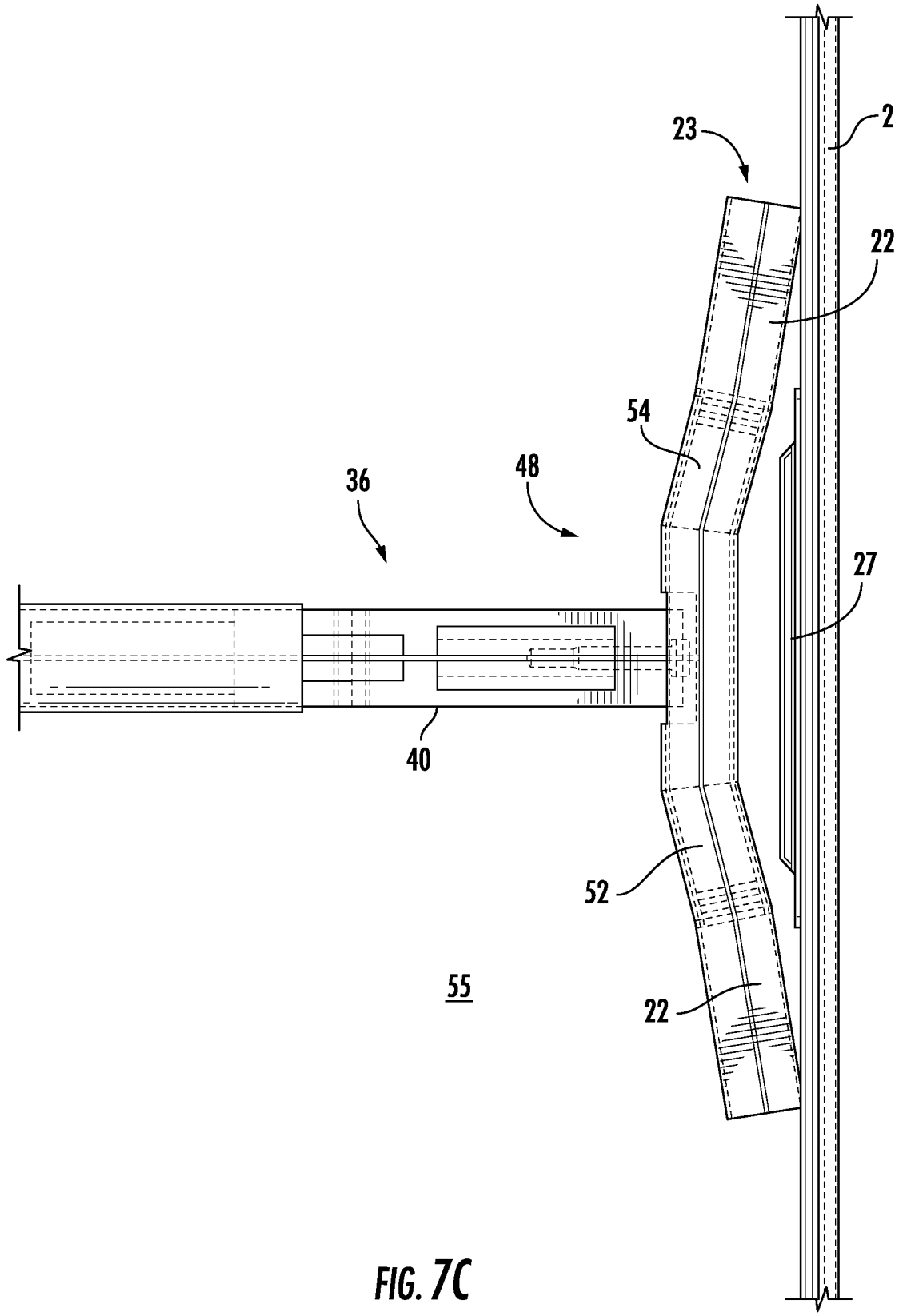

FIGS. 7A-7C illustrate the arrangement of the T-shaped element 48 of the knuckle member 36 within a pocket 23 of the flap when the flexible sheet 4, 6, 8 is in the fully deployed configuration. In the illustrated embodiment, the T-shaped element 48 is in the configuration shown in FIG. 6, so that the T-shaped element 48 presses the flap 22 outward against the adjacent surface 2. The T-shaped element 48 is received within pocket 23 disposed at the lower edge 25 of the flap 22 so that the flap (and the associated first or second side edge portion 16, 18 of the flexible sheet 4, 6, 8) moves with the T-shaped element 48. The shackle pad 27 can be any appropriate structure that extends away from the plane of the adjacent surface 2 toward the flap 22. In the illustrated embodiment the shackle pad 27 is a plate-like member that extends outward from the adjacent surface 2 and is sized to be received between the first and second end members 52, 54 of the T-shaped element 48 when the knuckle member 36 moves outward to press the flap 22 against the adjacent surface 2. As can best be seen in FIG. 7C, the flap 22 seals against the adjacent surface on either side of the shackle pad 27.

Figure 8A:
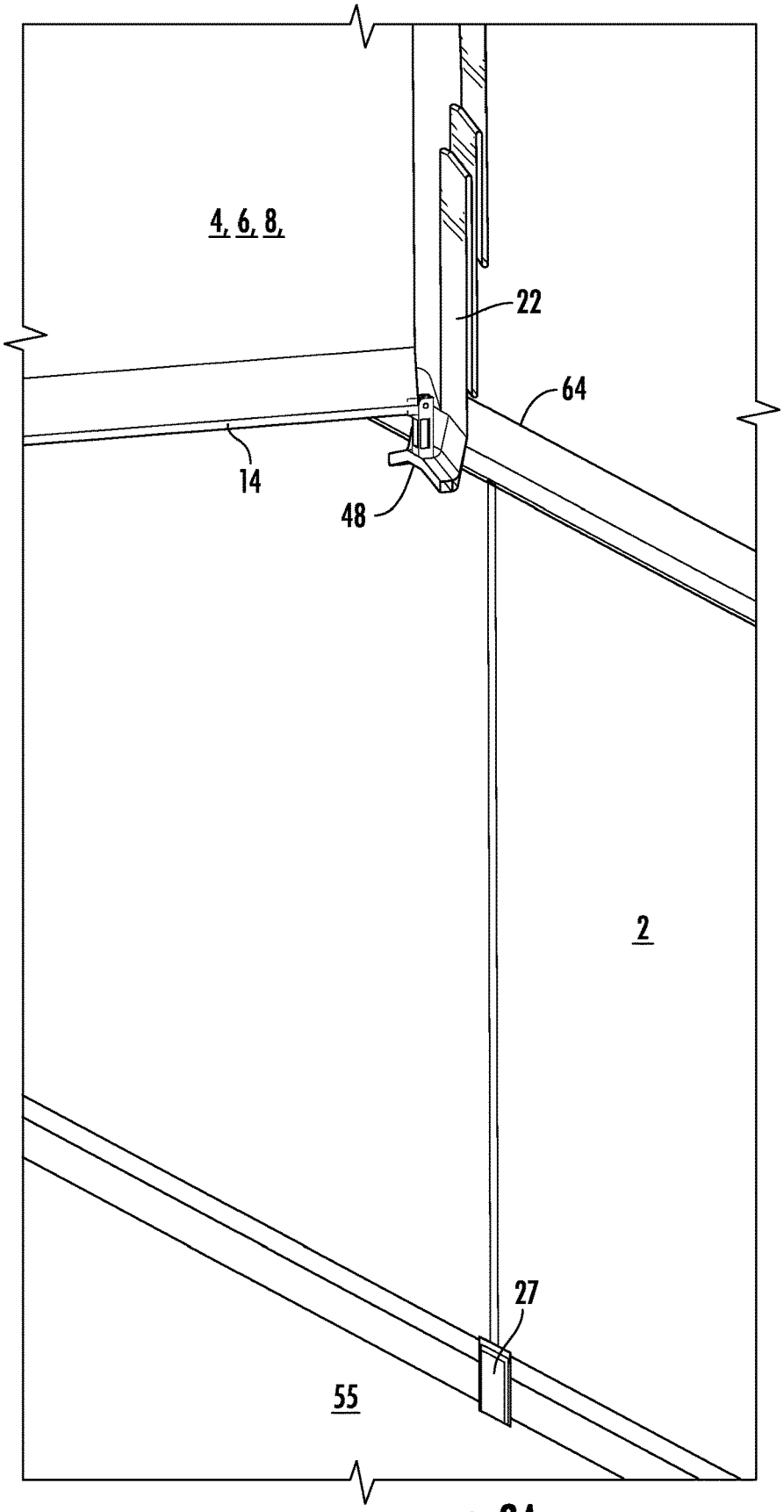
FIGS. 8A-C are isometric views of a flexible sheet, with knuckle member, in the partially deployed and fully deployed configurations.
Figure 8B:
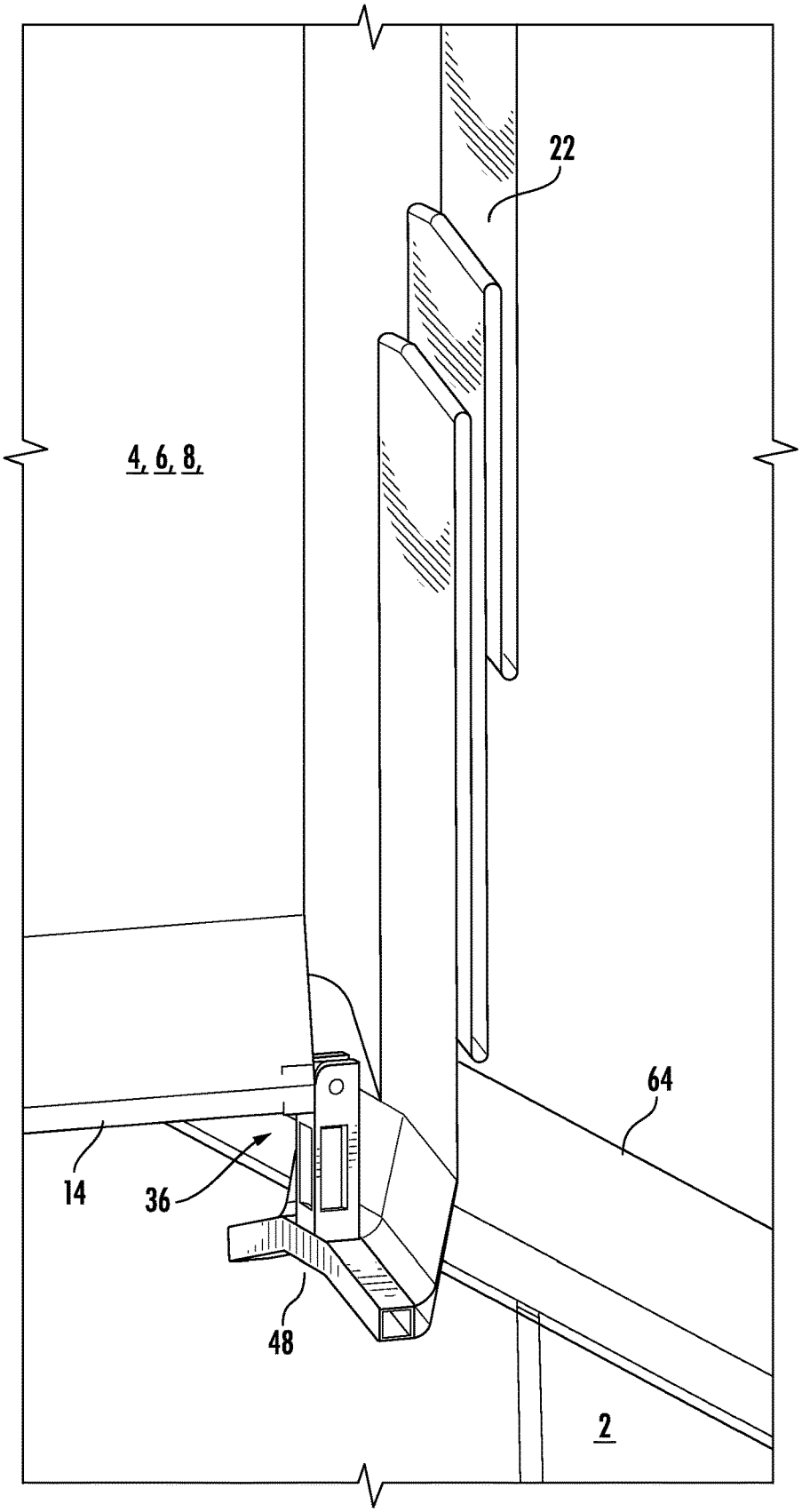
Figure 8C:
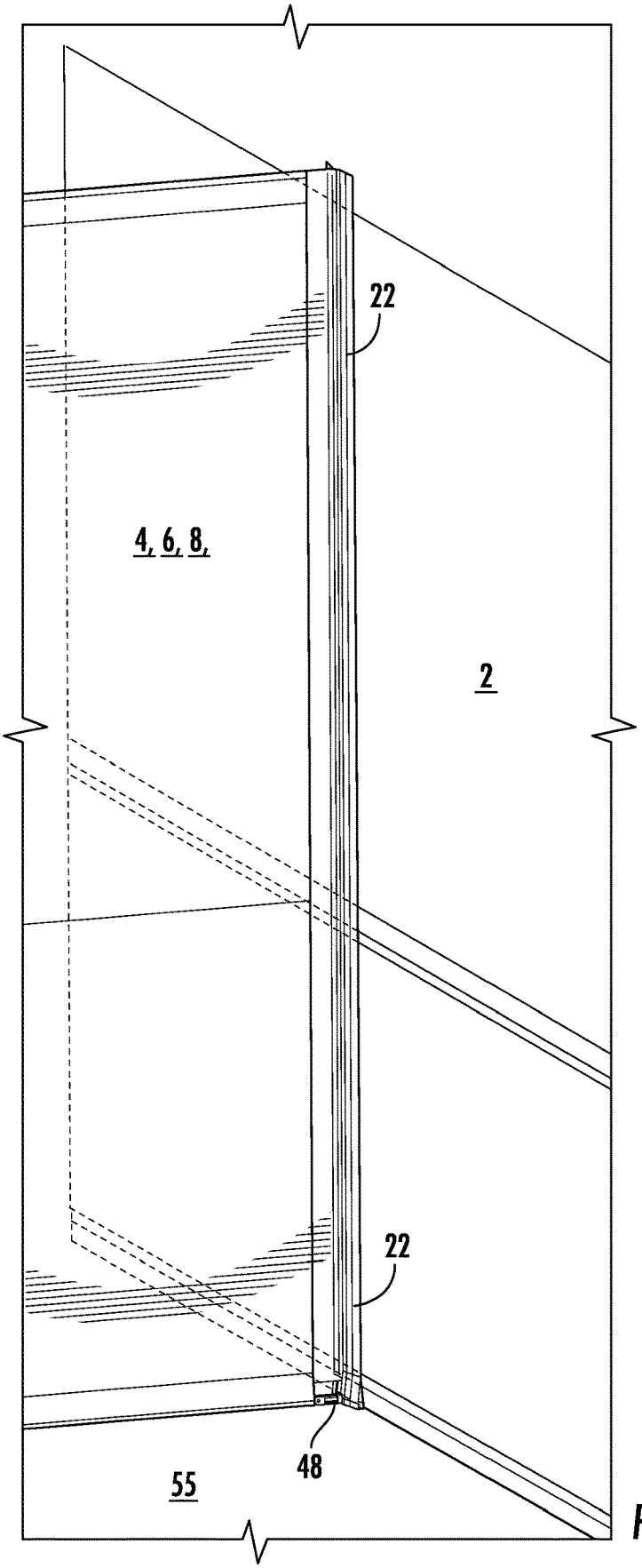

FIGS. 8A-8C illustrate an example flexible sheet 4, 6, 8 in the retracted configuration (FIGS. 8A, 8B) and the deployed configuration (FIG. 8C). In the retracted configuration the lower edge portion 14 of the flexible sheet 4, 6, 8 is positioned above an upper edge 64 of the adjacent surface 2. It will be appreciated that where the adjacent surface 2 does not have an upper edge (e.g., where the adjacent surface is an interior structural surface of the indoor facility) the flexible sheet 4, 6, 8 may simply be retracted far enough into the overhead so as not to interfere with use of the interior space. To transition the flexible sheet from the retracted configuration to the deployed configuration, the lifting cables (not shown) may be extended so that the flexible sheet 4, 6, 8 moves downward under the force of gravity (as aided by the weight of the tensioning member(s) 20 and the knuckle member(s) 36). In the deployed configuration, the lower edge portion 14 of the flexible sheet 4, 6, 8 may be positioned directly adjacent to the floor 55 of the indoor facility, and the T-shaped element 48 rotates in the manner previously described to press the flap 22 against the adjacent surface 2 to eliminate any gaps between the flexible sheet 4, 6, 8 and the adjacent surface. As previously mentioned, for embodiments of the flexible sheet 4, 6, 8 in which a flap 22 is not used, the knuckle member 36 may press the associated first or second side edge portion 16, 18 directly against the adjacent surface to eliminate any gaps between the flexible sheet 4, 6, 8 and the adjacent surface.

Figure 9:
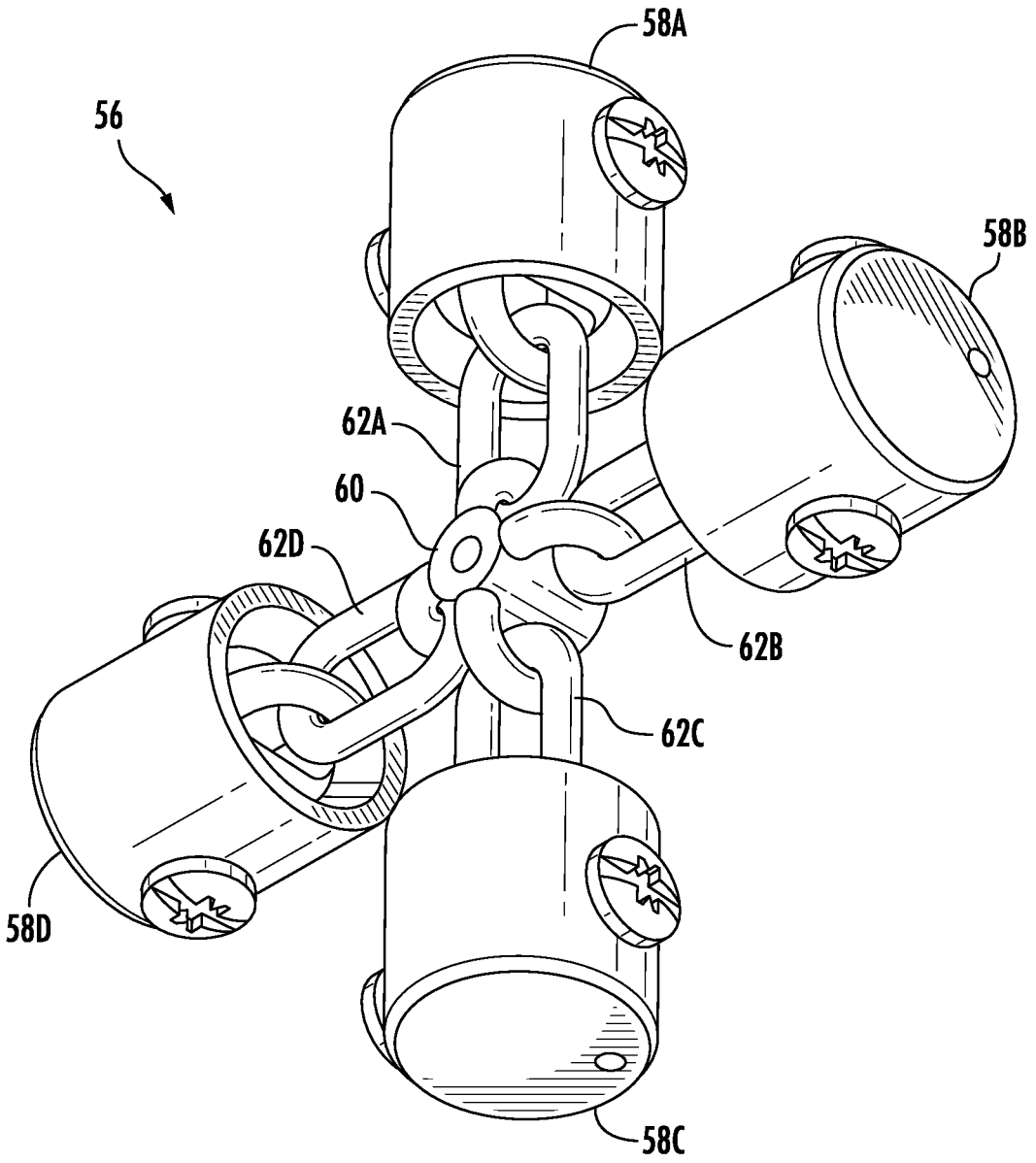
FIG. 9 is an isometric view of a coupler for use in connecting lower edges of adjacent flexible sheet members disposed in a X-configuration.

Referring now to FIG. 9, a connecting arrangement 56 for coupling the tensioning members 20 of multiple flexible sheets 4, 6 together, for example, when multiple flexible sheets are assembled to form an X-panel configuration (FIG. 1B). In the illustrated embodiment, the connecting arrangement 56 includes a plurality of couplers 58A-D for coupling to the tensioning members 20 of the flexible sheets 4, 6 making up the X-panel configuration. The plurality of couplers 58A-D may receive the ends of the individual tensioning members 20 and may themselves be interconnected to a central hub 60 via respective links 62A-D. This non-limiting example arrangement enables the tensioning members 20 (and the flexible sheets coupled thereto) to have a degree of rotational and translation freedom with respect to each other while offering a singular attachment point for coupling to a cable or other structure so that the flexible sheets 4, 6 can be raised/lowered together by retracting/deploying the cable or structure via vertical lifting. As will be appreciated, the couplers 58A-D and central hub 60 can maintain tension on a single lifting cable (as opposed to providing separate cables for each flexible sheet), and also holds the flexible sheets 4, 6 in a desired relation with respect to each other, which can prevent balls/objects of a specific size (e.g., soccer ball) from passing between the flexible sheets 4, 6 at the X-connection point. In some embodiments, a netting portion may be provided in or on the connecting arrangement 56 at this X-connection point to provide even tighter containment between flexible sheets 4, 6.

The disclosure also includes a method for pressing the edges of a plurality of flexible sheets against a perimeter fence or other structure to subdivide the facility into subspaces and to eliminate gaps between the panels and the perimeter fence/structure. The method may include suspending the flexible sheets from an overhead structure of a facility. Each of the flexible sheets can have a body portion, an upper edge portion, a lower edge portion, and a side edge portion. The flexible sheets can be moved from a retracted configuration to a deployed configuration, and a flap positioned on a side edge portion of the flexible sheet member may be pressed against the perimeter fence or other structure as the flexible sheets approach the fully deployed configuration. In some embodiments the step of pressing the flaps comprises pivoting T-shaped portions of knuckle members with respect to the lower edge portions of the associated flexible sheets. The T-shaped portions may be coupled to the flaps of the flexible sheets. In some embodiments the step of pressing the flaps comprises tensioning a top end of the flaps such that when the flexible sheets are in the deployed configuration the bottom ends of the flaps vertically support the T-shaped portions of the knuckle members. In some embodiments the T-shaped portions are rotatable about an axis of their associated knuckle member by a predetermined amount.

The method may further include maintaining the flexible sheets taut when the panels are in the deployed configuration. The method can also include engaging the T-shaped portions with shackles associated with the adjacent surface, where the shackles are received within a portion of the T-shaped portions when the flexible sheets are in the deployed configuration. In some embodiments the adjacent surface is a perimeter fence, and the step of pressing the flaps comprises pressing the flaps against the perimeter fence. In some embodiments the perimeter fence includes a reinforced vertical section positioned directly adjacent to each of the flaps, and the step of pressing the flaps comprises pressing the flaps against the reinforced vertical section.

As mentioned, the knuckle members 36 can include one or more openings 46 for coupling to one or more lifting cables so that the flexible sheets 4, 6, 8 can be raised/lowered by retracting/deploying the lifting cable. In some embodiments the opening 46 can be provided in the tensioning members 20 associated with the flexible sheets 4, 6, 8 so that one or more motors (not shown) can raise/lower the flexible sheets 4, 6 together as a unit by retracting the lifting cables that are coupled to the openings. The flaps 22 may be supported from the ceiling or other overhead structure of the facility. This support can be accomplished through the use of cables or other appropriate support elements. In some embodiments the flaps 22 may be supported from above using elastic straps or other elastic elements to tension the flaps. Alternatively, the flaps 22 may be supported by tensioning members coupled to the upper edge portion 12 of the flexible sheets 4, 6, 8. Such tensioning members may be longitudinal tubular elements or other structural elements similar to the tensioning members 20 coupled to the lower edge portion 14 of the flexible sheets 4, 6, 8. Thus arranged, when the flexible sheets 4, 6, 8 are in the fully deployed condition, the lifting cables attached to the tensioning members 20 of the flexible sheets may be "over-extended" so that the weight of the flexible sheets is borne by the flaps 22 instead of the lifting cables and tensioning members 20. Causing the flaps 22 to bear the weight of the associated flexible sheets 4, 6, 8 ensures that the knuckle members 36 will be activated (i.e., that the second portion 40 will rotate with respect to the first portion 36) when the flexible sheets are in the fully deployed configuration. This, in turn, ensures that the flaps 22 and flap segments 32, 34 will be taut, and will be pressed into engagement with the adjacent surface 2 when the flexible sheets are fully deployed. For embodiments of flexible sheets 4, 6, 8 that do not employ flaps 22, the disclosed arrangement will function similarly to ensure that the first and/or second side edges 16, 18 will be pressed into engagement with the adjacent surface 2 when the flexible sheets are in the fully deployed configuration.

While the present disclosure has been described with reference to certain embodiments, numerous modifications, alterations and changes to the described embodiments are possible without departing from the spirit and scope of the invention, as defined in the appended claims. Accordingly, it is intended that the disclosure not be limited to the described embodiments, but that it has the full scope defined by the language of the following claims, and equivalents thereof.

What is claimed is:

1. A system for maintaining an edge of a flexible sheet member in a predetermined position with respect to an adjacent surface, the system comprising:

a flexible sheet member having a body portion, an upper edge portion, a lower edge portion, and a side edge portion, the upper edge portion coupleable to a vertical support mechanism for vertically suspending the flexible sheet member, the flexible sheet member movable between a retracted configuration and a deployed configuration; and a knuckle member having first and second portions pivotably coupled to each other, the first portion coupled to the lower edge portion of the flexible sheet member, the second portion having a T-shaped first end coupled to the side edge portion of the flexible sheet member;

wherein when the flexible sheet member is in the retracted configuration the second portion of the knuckle member is oriented at an oblique angle with respect to the first portion, and wherein when the flexible sheet member is in the deployed configuration the second portion of the knuckle member is oriented coaxial with the first portion and the T-shaped first end of the knuckle member moves the side edge portion outward away from the first portion and toward the adjacent surface.

2. The system of claim 1, wherein the T-shaped first end is rotatable about an axis of the second portion by a predetermined amount.

3. The system of claim 1, wherein the T-shaped member has a central member and first and second end members, the central member oriented perpendicular to an axis formed by the second portion, and wherein the first and second end members are oriented to form an oblique angle with respect to the central member.

4. The system of claim 1, wherein the side edge portion further comprises a flap oriented perpendicular to a plane formed by the body portion when the flexible sheet member is in the deployed configuration, wherein the T-shaped first end is coupled to the flap, and wherein when the flexible sheet member is in the deployed configuration the second portion of the knuckle member is oriented coaxial with the first portion and T-shaped first end of the knuckle member moves the flap outward away from the first portion and toward the adjacent surface.

5. The system of claim 4, wherein a top end of the flap is coupled to a vertical tensioning element such that when the flexible sheet member is in the deployed configuration a bottom end of the flap provides vertical support for the second portion of the knuckle member.

6. The system of claim 1, wherein the lower edge portion is coupled to a tensioning member for maintaining the flexible sheet member taut when the flexible sheet member is in the deployed configuration.

7. The system of claim 6, wherein the first portion of the T-shaped first end is coupled to the tensioning member.

8. The system of claim 3, further comprising a shackle pad associated with the adjacent surface, the shackle pad received within the central member and the first and second members when the flexible sheet member is in the deployed configuration.

9. The system of claim 1, wherein the adjacent surface comprises a perimeter fence, the perimeter fence including a reinforced vertical section directly adjacent to the side edge portion of the flexible sheet member when the flexible sheet member is in the deployed configuration.

10. A device for maintaining an edge of a flexible sheet member in a predetermined position with respect to an adjacent surface, the device comprising:

a knuckle member having first and second portions pivotably coupled to each other, the first portion coupleable to a lower edge portion of a flexible sheet member, the second portion having a T-shaped first end coupleable to a side edge portion of the flexible sheet member;

wherein in a first configuration the second portion of the knuckle member is oriented at an oblique angle with respect to the first portion, and wherein in a second configuration the second portion of the knuckle member is oriented coaxial with the first portion and the T-shaped first end of the knuckle member is configured to move the side edge portion outward away from the first portion and toward the adjacent surface.

11. The device of claim 10, wherein the T-shaped first end is coupleable to a flap of the side edge portion of the flexible sheet member; and wherein in the second configuration the second portion of the knuckle member is oriented coaxial with the first portion and the T-shaped first end of the knuckle member is configured to move the flap outward away from the first portion and toward the adjacent surface.

12. The device of claim 10, wherein the T-shaped first end is rotatable about an axis of the second portion by a predetermined amount.

13. The device of claim 10, wherein T-shaped member has a central member and first and second end members, the central member oriented perpendicular to an axis formed by the second portion, and wherein the first and second end members are oriented to form an oblique angle with respect to the central member.

14. The device of claim 10, wherein the first portion is tubular and includes an opening for receiving a lifting cable.

* * * * *